US011001278B2

(12) United States Patent
Abou-Eid et al.

(10) Patent No.: US 11,001,278 B2
(45) Date of Patent: May 11, 2021

(54) PROCESS FOR MONITORING AN AIR CONDITIONING SYSTEM OF A RAILWAY VEHICLE AND RAILWAY VEHICLE COMPRISING AN AIR CONDITIONING SYSTEM IMPLEMENTING THIS PROCESS

(71) Applicant: Alstom Transport Technologies, Saint-Ouen (FR)

(72) Inventors: Rami Abou-Eid, Paris (FR); Andrea Staino, Paris (FR); Philippe Chevalier, Rueil Malmaison (FR)

(73) Assignee: Alstom Transport Technologies, Saint-Ouen (FR)

( * ) Notice: Subject to any disclaimer, the term of this patent is extended or adjusted under 35 U.S.C. 154(b) by 295 days.

(21) Appl. No.: 16/122,509

(22) Filed: Sep. 5, 2018

(65) Prior Publication Data

US 2019/0071103 A1 Mar. 7, 2019

(30) Foreign Application Priority Data

Sep. 5, 2017 (FR) ..... 1758158

(51) Int. Cl.
*B61D 27/00* (2006.01)
*F25B 49/00* (2006.01)
(Continued)

(52) U.S. Cl.
CPC ..... *B61D 27/0018* (2013.01); *B61L 15/0072* (2013.01); *B61L 15/0081* (2013.01);
(Continued)

(58) Field of Classification Search
CPC ..... B61D 27/0018; B61L 15/0072; B61L 15/0081; F25B 45/00; F25B 2500/19; F25B 2500/222; F25B 2700/04; F25B 49/005
(Continued)

(56) References Cited

U.S. PATENT DOCUMENTS 2,089,372 A * 8/1937 Henney ..... B61D 27/0018 454/87
7,631,508 B2 12/2009 Braun et al.
(Continued)

FOREIGN PATENT DOCUMENTS

EP 2034261 A1 3/2009
EP 2472203 A1 7/2012
EP 2546588 A1 1/2013

OTHER PUBLICATIONS

Search Report for FR Application 1758158 dated Jan. 10, 2018.

*Primary Examiner* — Kenneth J Hansen
*Assistant Examiner* — Dana K Tighe
(74) *Attorney, Agent, or Firm* — Thompson Coburn LLP; Steven M. Ritchey

(57) ABSTRACT

A process for supervising an air conditioning system of a railway vehicle. The process comprising the following steps: a) after starting the air conditioning system, measuring physical properties relative to the refrigerant; b) from the physical properties measured during step a), calculating thermodynamic properties; c) from the thermodynamic properties calculated during step b), calculating the density, optionally averaged, of the refrigerant inside each component of the air conditioning system; d) using manufacturer data, which includes the dimensions of each component of the air conditioning system, calculating the passage volume of the refrigerant inside each component of the air conditioning system; e) using the values calculated in steps c) and d) to calculate the total mass of refrigerant contained inside the air conditioning system; and f) comparing the total mass of refrigerant calculated in step e) with the total mass of refrigerant originally contained inside the air conditioning system.

11 Claims, 3 Drawing Sheets

(51) Int. Cl.
*B61L 15/00* (2006.01)
*F25B 45/00* (2006.01)

(52) U.S. Cl.
CPC ..... *F25B 45/00* (2013.01); *F25B 49/005* (2013.01); *F25B 2500/19* (2013.01); *F25B 2500/222* (2013.01); *F25B 2700/04* (2013.01); *F25B 2700/1931* (2013.01); *F25B 2700/1933* (2013.01); *F25B 2700/21151* (2013.01); *F25B 2700/21162* (2013.01); *F25B 2700/21163* (2013.01); *F25B 2700/21174* (2013.01); *F25B 2700/21175* (2013.01)

(58) Field of Classification Search
USPC ..... 454/83, 84, 87
See application file for complete search history.

(56) References Cited

U.S. PATENT DOCUMENTS

| | | | | |
|---|---|---|---|---|
| 9,239,180 | B2 * | 1/2016 | Ochiai | F25B 49/005 |
| 9,261,542 | B1 * | 2/2016 | West | F25B 49/00 |
| 2007/0163276 | A1 | 7/2007 | Braun et al. | |
| 2011/0036104 | A1 | 2/2011 | Toyoshima et al. | |

* cited by examiner

PROCESS FOR MONITORING AN AIR CONDITIONING SYSTEM OF A RAILWAY VEHICLE AND RAILWAY VEHICLE COMPRISING AN AIR CONDITIONING SYSTEM IMPLEMENTING THIS PROCESS

CROSS-REFERENCE TO RELATED APPLICATIONS

This application claims the benefit of FR Application No. 17 58158, filed Sep. 5, 2017, which is incorporated herein by reference in its entirety.

FIELD OF THE INVENTION

The present invention relates to a process for supervising an air conditioning system of a railway vehicle. The invention also relatives to a railway vehicle comprising an air conditioning system implementing this process.

BACKGROUND OF THE INVENTION

In a known manner, modern railway vehicles intended to carry passengers are generally equipped with air conditioning systems in order to improve traveler comfort. These air conditioning systems, also known under the name HVAC, which stands for "Heating, Ventilation and Air Conditioning", are typically based on a thermodynamic refrigeration cycle using a refrigerant.

US 2007/0163276 A1 discloses a process for evaluating the quantity of refrigerant circulating in an air conditioning system. The system traditionally includes an evaporator, a condenser, a compressor and an expander. This process is of the semi-empirical type, i.e., one uses data adjusted based on experimental results in order to simplify the calculations. Typically, paragraph [0034] of US 2007/0163276 A1 explains that certain parameters, in particular parameter $k_{ch}$, are calculated from an experimental model. This experimental model is established by varying, over several cycles, the mass of the refrigerant from 60 to 140% relative to a nominal mass, the air flow of the evaporator, also from 60 to 140% relative to a nominal air flow, the air flow of the condenser, from 32% to 100% of its nominal value, etc. It is therefore understood that this experimental model must be established for each air conditioner line, which is particularly costly.

US 2011/0036104 A1 discloses a substantially equivalent process, in which certain constants are established, in advance, from experimental results (see in particular paragraph [0168]).

BRIEF SUMMARY OF THE INVENTION

The invention aims to resolve these drawbacks by proposing a new monitoring process allowing the real-time calculation of the mass of refrigerant contained in the system, without performing any test beforehand. Maintenance operations may therefore be planned intelligently, for example when the loss of mass exceeds a certain threshold, indicating the presence of a leak.

To that end, the invention relates to a process for monitoring an air conditioning system of a railway vehicle, this air conditioning system including several components, which include a compressor, a condenser, an evaporator, an expander and a refrigerant circuit, this air conditioning system being intended to provide air conditioning for a zone located inside the railway vehicle. This process comprises the following steps:

a) after starting the air conditioning system, measuring physical properties relative to the refrigerant,
b) from the physical properties measured during step a), calculating thermodynamic properties,
c) from the thermodynamic properties calculated during step b), calculating the density, optionally averaged, of the refrigerant inside each component of the air conditioning system,
d) using manufacturer data, which includes the dimensions of each component of the air conditioning system, calculating the passage volume of the refrigerant inside each component of the air conditioning system,
e) using the values calculated in steps c) and d) to calculate the total mass of refrigerant contained inside the air conditioning system, and
f) comparing the total mass of refrigerant calculated in step e) with the total mass of refrigerant originally contained inside the air conditioning system.

Owing to the invention, by calculating, in real-time, the mass of refrigerant present in the air conditioning system from physical properties measured during its operation, one has real-time information on the health of the air conditioning system. Additionally, the process is carried out noninvasively, during the operation of the system. This means that it is not necessary to open or disassemble the system to carry out the measurements of the physical properties. On the contrary, the sensors are integrated into the system. There is therefore no need to interrupt the refrigerant cycle, for example, or to deposit the system and make it unavailable in order to carry out the evaluation.

The process allows a quick detection of a loss of refrigerant mass, and therefore the presence of a leak. The calculation of the refrigerant mass does not require any test or other prior experimentation and is transposable to any type of air conditioning system, i.e., irrespective of the size of the system. Furthermore, maintenance operations may take place only when a loss of mass is detected, i.e., a leak. Thus, the maintenance cost of the air conditioning system is reduced, and the risk of untimely failure of the air conditioning system is limited.

According to advantageous but optional aspects of the invention, such a process may incorporate one or more of the following features, considered alone or according to any technically allowable combination:

During step a), the following physical properties are measured:
- the pressure of the refrigerant at the inlet of the compressor,
- the pressure of the refrigerant at the outlet of the compressor,
- the temperature of the refrigerant at the inlet of the condenser,
- the temperature of the refrigerant at the outlet of the condenser,
- the temperature of the refrigerant at the inlet of the evaporator,
- the temperature of the refrigerant at the outlet of the evaporator,
- the temperature of the refrigerant at the inlet of the compressor, and
- the temperature of the refrigerant at the outlet of the compressor.

During step a), the temperature of the refrigerant at the inlet of the compressor and the temperature of the refrigerant at the outlet of the evaporator are measured by a same temperature sensor and/or the temperature of the refrigerant at the inlet of the condenser and the temperature of the refrigerant at the outlet of the compressor are measured by a same temperature sensor.

Steps a) to f) are reiterated over time during the operation of the air conditioning system, preferably regularly with a predefined frequency.

Step a) is carried out automatically using sensors and steps b) to f) are carried out automatically by an electronic calculator.

Step f) consists of determining a health index of the air conditioning system, by obtaining the quotient of the total mass of refrigerant calculated in step e) over the total mass of refrigerant originally contained in the air conditioning system.

The health index is compared with a reference value, for example of about 80%, the air conditioning system then being considered no longer to work in a satisfactory manner if the health index is below the reference value, and otherwise being considered to work in a satisfactory manner.

The process further comprises a step g) consisting of emitting an alert signal if, at the end of step f), the air conditioning system is determined as no longer working in a satisfactory manner.

The thermodynamic properties calculated in step b) include:

the enthalpy at the inlet of the evaporator,
the enthalpy at the outlet of the evaporator,
the mass flow rate of the compressor,
the enthalpy at the inlet of the condenser,
the enthalpy at the outlet of the condenser,
the enthalpy absorbed by the compressor, and
the enthalpy supplied by the compressor.

According to another aspect, the invention relates to a railway vehicle comprising an air conditioning system for supplying air conditioning to a zone located inside the railway vehicle, this air conditioning system including several components, which include a compressor, a condenser, an evaporator, an expander and a refrigerant circuit, the air conditioning system further including sensors for measuring physical properties relative to the refrigerant after the air conditioning system is turned on. According to the invention, the railway vehicle comprises an electronic calculator intended to control the air conditioning system and programmed to carry out steps consisting of:

calculating thermodynamic properties from the measured physical properties, calculating the density, optionally averaged, of the refrigerant inside each component of the air conditioning system, from the thermodynamic properties, using manufacturer data, which includes the dimensions of each component of the air conditioning system, calculating the passage volume of the refrigerant inside each component of the air conditioning system, from the volume densities and passage volumes of the refrigerant inside each component, calculating the total mass of refrigerant contained inside the air conditioning system, and comparing the calculated mass with the total mass of refrigerant originally contained inside the air conditioning system.

BRIEF DESCRIPTION OF THE DRAWINGS

The invention will be better understood and other advantages thereof will appear more clearly in light of the following description of one embodiment of a monitoring process and an air conditioning system for a railway vehicle, provided solely as a non-limiting example and done in reference to the appended drawings.

DETAILED DESCRIPTION OF THE INVENTION

Figure 1:
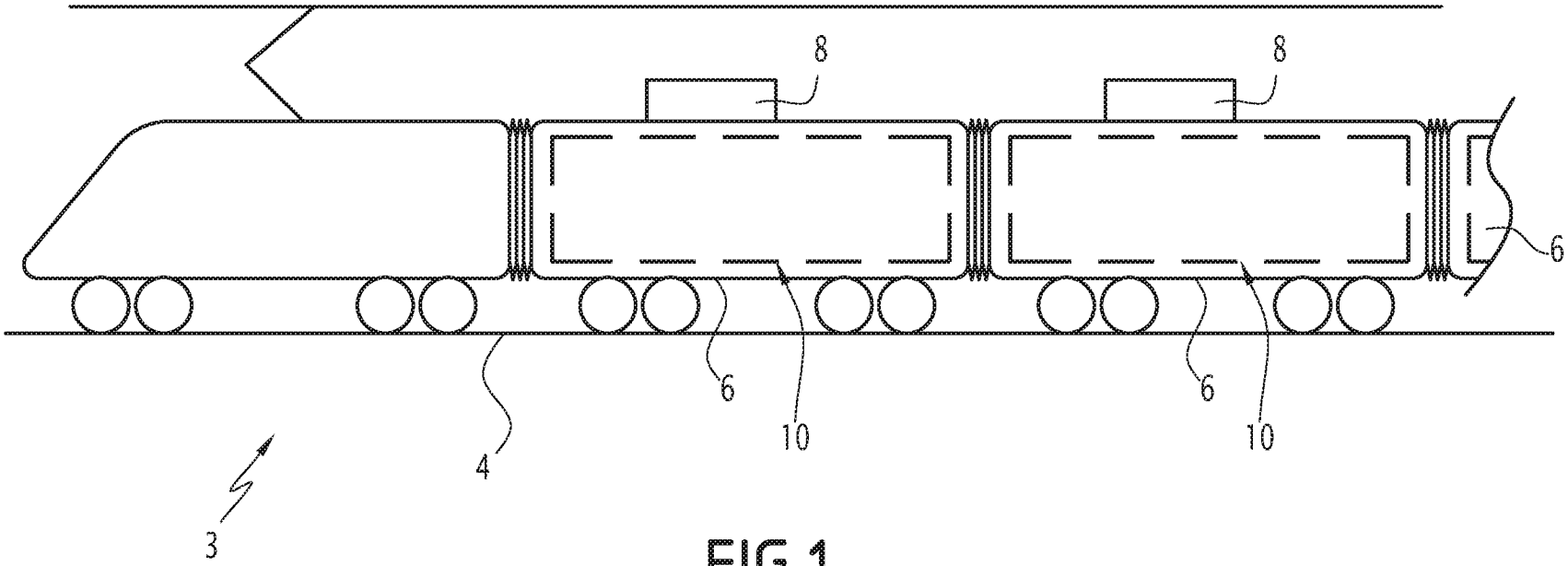
FIG. 1 is a simplified schematic illustration of a railway vehicle comprising an air conditioning system according to the invention.

FIG. 1 shows a railway vehicle 2, for example a passenger train or an urban rail transport vehicle, such as a tram or a subway.

In a known manner, the vehicle 3 is suitable for rolling on a railroad track 4 and to that end comprises railway wheels and at least one engine capable of propelling the vehicle 2.

The vehicle 3 comprises one or several railway cars 6 intended to receive passengers. Each car 6 is equipped with an air conditioning system 8 that is configured to provide air conditioning to a space 10 inside the car 6. "Air condition" here means that the system 8 is capable of bringing the temperature of the air inside the space 10 to a predefined setpoint temperature.

In the illustrated example, each air conditioning system 8 is received in a dedicated equipment cabinet, here housed on the roof of the corresponding car 6. Other arrangements are, however, possible.

In this example, the space 10, also called zone 10, takes up all of the useful space of the car 6.

Alternatively, several air conditioning systems 8 can be associated with a same car 6, to provide air conditioning to several separate zones 10 within a same car 6, these zones 10 for example being associated with separate compartments of the car 6. In this case, the systems 8 can operate independently.

According to still another alternative, several systems 8 can be used to air condition a same zone 10. In this case, they operate jointly.

Figure 2:
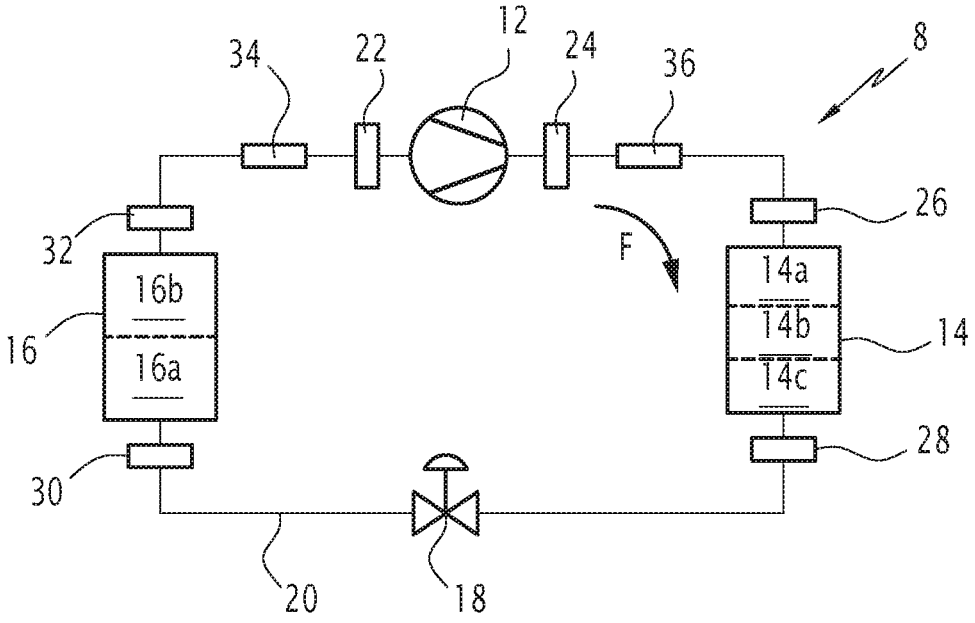
FIG. 2 is a simplified block diagram of an air conditioning system of the railway vehicle of FIG. 1.

FIG. 2 shows an example of an air conditioning system 8. This system 8 includes a compressor 12, a condenser 14, an evaporator 16 and an expander 18, fluidly connected to one another by a refrigerant circuit 20, also called coolant. The condenser 14 and the evaporator 16 here are provided with heat exchangers intended to facilitate the transfer of heat between the refrigerant and surrounding air.

The compressor 12 comprises an electric motor that drives a mechanical member suitable for compressing the refrigerant. The compressor 12 is therefore suitable for supplying mechanical work to the refrigerant. The compressor 12 is for example a piston compressor, or a rotary compressor, or a compressor according to any other appropriate technology. The motor of the compressor 12 here is supplied with electricity by a power source outside the system 8, for example using an electricity supply system of the vehicle 3.

Here, the circuit 20 is formed by several pipes connected to the components of the system 8 sealably. A first pipe connects an outlet of the compressor 12 to an inlet of the condenser 14. A second pipe connects the outlet of the condenser 14 to an inlet of the expander 18. A third pipe connects an outlet of the expander 18 to an inlet of the evaporator 16. A fourth pipe connects an outlet of the evaporator 16 to an inlet of the compressor 12. The circuit 20 comprises a refrigerant, which circulates within the circuit 20.

The system 8 also includes an outside air inlet opening and a hot air outlet, not illustrated, which both emerge outside the vehicle 3.

The system 8 further includes a cool air outlet, not illustrated, which emerges inside the car 6 to supply cool air intended to provide air conditioning to the space 10. For example, the car 6 includes an air distribution circuit including pipes connected to said cool air outlet and emerging in the space 10 through aeration nozzles.

The system 8 here is suitable for operating according to a thermodynamic cooling cycle, for example according to a steam compression cycle of a refrigerant, known in itself.

In a normal operation of the system 8, the fluid flows in the circuit 20 in the circulation direction illustrated by arrow F, passing from the outlet of the compressor 12 toward the condenser 14, then toward the expansion expander 18 and the evaporator 16 before returning to the inlet of the compressor 12.

The air coming from outside the vehicle 3 forms an incoming air flow that circulates at the evaporator 16, outside the latter, between the outside air inlet and the cool air outlet. When the system 8 is operating and the refrigerant circulates in the evaporator 16, the fluid changes state and evaporates while absorbing a first quantity of heat $Q_L$ during each cycle, which cools the incoming air flow during its passage at the evaporator 16, in particular owing to the heat exchanger. This air thus cooled is conveyed toward the inside of the car 6, via the cool air outlet, to provide air conditioning to the space 10.

The refrigerant next circulates to the compressor 12, then toward the condenser 14, where it again changes state, and condenses while giving off a second quantity of heat $Q_H$ toward the outside during each cycle, which heats the outgoing air flow during its passage at the condenser 14. The air thus heated is discharged toward the outside of the vehicle 3, via a hot air outlet.

Advantageously, the system 8 includes monitoring means, which aim to conduct a real-time measurement of the health of the system 8, requiring a maintenance operation.

The system 8 also includes an electronic calculator 40 programmed to control system 8 and monitor the health of the system 8. This calculator 40 is for example on board the system 8, here inside the equipment cabinet in which the system 8 is housed.

Figure 4:
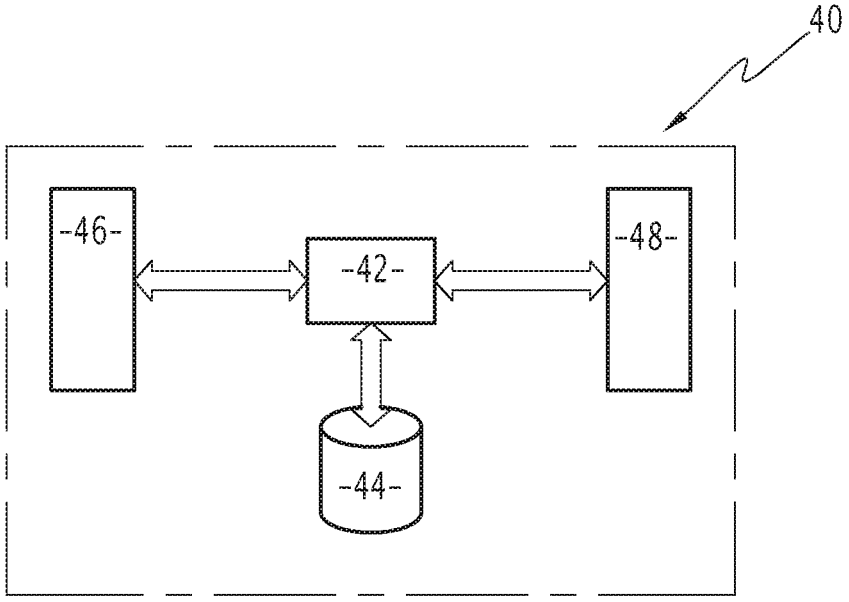
FIG. 4 is a block diagram representative of a calculator of the air conditioning system.

The calculator 40 illustrated schematically in FIG. 4. It advantageously comprises a logic computing unit 42, such as a microprocessor or a programmable microcontroller, an information recording medium 44, such as a computer memory, for example a "Flash" memory module, a data input interface 46 and a data output interface 48.

Advantageously, and as shown in FIG. 4, the components of the calculator 40 are connected to one another by an internal data bus.

The medium 44 comprises instructions executable to carry out the process according to the invention, in particular in order to monitor the operation of the system 8. These instructions are executed by the logic unit 42.

The input interface 46 here is configured to receive measurement signals coming from various aforementioned sensors equipping the system 8. For example, the input interface 46 is connected to these sensors using wired connections and/or wireless data connections.

The output interface 48 is in particular configured to send data representative of the health of the system 8, such as a signal representative of the health of the system 8, or even an alert signal indicating a failure requiring an intervention. This data is for example sent to a remote computer server, for example installed within a maintenance center of the vehicle 3. The sending is done using a telecommunications link, such as a radio link, or via the Internet and/or a wireless telephony network and/or a satellite link. The data may also be stored within the medium 44 and/or within a computer on board the vehicle 3.

Thus, in this example, the sensors and the calculator 40 together form the aforementioned monitoring means.

An example operation of the monitoring process is now described. It is considered for the example that the air conditioning system is not new, i.e., that the process is carried out after the commissioning of the air conditioning system 8.

During a step a), the physical properties relative to the refrigerant are measured. Typically, the following physical properties are measured:

- the pressure of the refrigerant $P_{suc}$ at the inlet of the compressor 12,
- the pressure of the refrigerant $P_{dis}$ at the outlet of the compressor 12,
- the temperature $T_{cond,in}$ of the refrigerant at the inlet of the condenser 14,
- the temperature $T_{cond,out}$ of the refrigerant at the outlet of the condenser 14,
- the temperature $T_{evap,in}$ of the refrigerant at the inlet of the evaporator 16,
- the temperature $T_{evap,out}$ of the refrigerant at the outlet of the evaporator 16,
- the temperature $T_{suc}$ of the refrigerant at the inlet of the compressor 12, and
- the temperature $T_{dis}$ of the refrigerant at the outlet of the compressor 12.

To that end, the system 8 comprises a first pressure sensor 22 and a second pressure sensor 24, suitable for measuring the pressures $P_{suc}$ and $P_{dis}$, respectively. The system 8 also comprises a temperature sensor 26 for measuring the temperature "$T_{cond,in}$" of the refrigerant at the inlet of the condenser 14, a temperature sensor 28 for measuring the temperature "$T_{cond,out}$" of the refrigerant leaving the condenser 14, a temperature sensor 30 for measuring the temperature "$T_{evap,in}$" of the refrigerant at the inlet of the evaporator 16, a temperature sensor 32 for measuring the temperature "$T_{evap,out}$" of the refrigerant at the outlet of the evaporator 16, a temperature sensor 34 for measuring the temperature "$T_{suc}$" of the refrigerant at the inlet of the compressor 12 and a temperature sensor 36 for measuring the temperature "$T_{dis}$" of the refrigerant at the outlet of the compressor 12.

Alternatively, one of the temperature sensors 32 and 34 can be omitted. Indeed, in the cases where the system 8 occupies a smaller volume and the evaporator 16 is close to the inlet of the compressor 12, the temperature variation of the refrigerant between the outlet of the evaporator 16 and the inlet of the compressor 12 is negligible, such that only one of the temperature sensors 32 and 34 is sufficient to measure the temperature of the refrigerant in these two locations. In other words, the temperature "$T_{suc}$" and the temperature "$T_{evap,out}$" are then measured by a same temperature sensor 32 or 34.

The same is true for the temperature sensors 26 and 36, one of which can be omitted. In other words, the temperature "$T_{dis}$" and the temperature "$T_{cond,in}$" are then measured by a same temperature sensor 26 or 36.

During a subsequent step b), thermodynamic properties are calculated from the physical properties measured during step a). Typically, the thermodynamic properties include:

- the enthalpy at the inlet of the evaporator: $h_{evap,\ in}=f(T_{cond,\ out};\ P_{dis})$
- the enthalpy at the outlet of the evaporator: $h_{evap,\ out}=f(T_{evap,\ out};\ P_{suc})$
- the mass flow rate of the compressor: $\dot{m}_{ref}=f(P_{dis};\ P_{suc})$
- the enthalpy at the inlet of the condenser: $h_{cond,\ in}=f(T_{cond,\ in};\ P_{dis})$
- the enthalpy at the outlet of the condenser: $h_{cond,\ out}=f(T_{cond,\ out};\ P_{dis})$
- the enthalpy absorbed by the compressor: $h_{suc}=f(T_{suc};\ P_{suc})$
- the enthalpy supplied by the compressor: $h_{dis}=f(T_{dis};\ P_{dis})$ In the definitions above and below, the notation f( . . . ) generically indicates that a property depends on one or several measured and/or physical properties, according to a predefined relationship. This predefined relationship is not necessarily the same for all definitions, although the same notation f( . . . ) is used here. The formulas for calculating thermodynamic properties are well known from the literature on the subject, which is why they are not recalled in this document.

The calculations in this step b) are done automatically by the calculator 40.

During a later step c), one calculates, from the thermodynamic properties calculated during step b), the density, optionally averaged, of the refrigerant inside each component of the air conditioning system.

More specifically, the calculator 40 in particular calculates:

- the average density of the refrigerant inside the evaporator 16: $\overline{\rho}_{evap}=f(h_{evap,in},\ h_{evap,out},\ p_{suc},\ \dot{m}_{ref})$;
- the average density of the refrigerant inside the condenser 14: $\overline{\rho}_{cond}=f(h_{cond,in},\ h_{cond,out},\ p_{diz},\ \dot{m}_{ref})$;
- the average density of the refrigerant in the circuit 20: $\overline{\rho}_{tube,i}=f(h_{tube,i},p_{tube,i},\dot{m}_{ref})$;

Optionally, the air conditioning system 8 also includes an accumulator (not shown) arranged between the condenser 14 and the detector 18. The accumulator makes it possible to store part of the refrigerant if all of the refrigerant is not used in the cooling cycle. In this case, the calculator is also used to calculate the average density of refrigerant inside the accumulator: $\overline{\rho}_{receiver}=f(h_{cond,out},\ p_{dis},\ \dot{m}_{ref})$.

During a later step d), manufacturer data is used to calculate the passage volume of the refrigerant inside each component of the air conditioning system, i.e.:

- the passage volume $V_{internal,evap}$ of the refrigerant inside the evaporator,
- the passage volume $V_{internal,cond}$ of the refrigerant inside the condenser,
- the passage volume $V_{internal,tube,i}$ of the refrigerant inside each pipe 20*i* of the circuit 20, and optionally,
- the volume of the accumulator $V_{internal,\ receiver}$.

The manufacturer data typically includes the dimensions of each component of the air conditioning system (length, width, height, section, etc.). This data is known, and will therefore simply be stored as input parameters in the information recording medium 44 of the calculator, i.e., in the memory.

Figure 3:
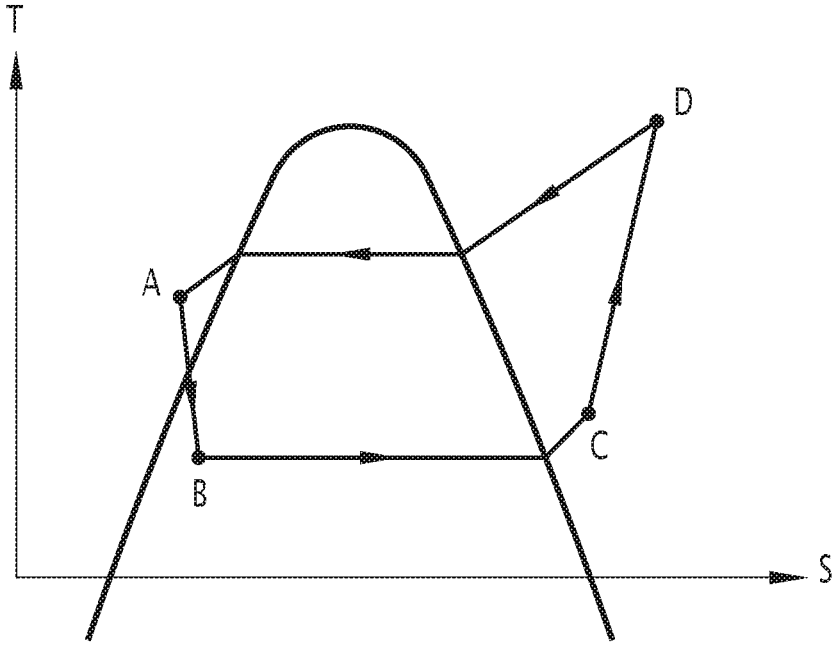
FIG. 3 is a Temperature-entropy diagram of the air conditioning system during operation.

FIG. 3 is an enthalpy diagram showing the cooling cycle of the air conditioning system 8. The dome-shaped curve is the phase curve. Below the curve, the fluid is in a diphasic state, i.e., in the form of a liquid-vapor mixture. To the right of the curve, the fluid is in the gaseous state. To the left of the curve, the fluid is in the liquid state.

The arrows show the order of the phase transformations. Between points A and B, the fluid undergoes an expansion in the expander 18 and goes from the liquid state to the diphasic state. Between points B and C, the fluid passes through the evaporator 16 and goes from the diphasic state to the vapor state (a single phase change). Thus, the evaporator includes a segment 16*a*, along which the fluid is in the diphasic state, and a segment 16*b*, along which the fluid is in the vapor state. Between points C and D, the fluid is compressed by the compressor 12. Between points D and A, the fluid passes through the condenser 14. Through the condenser 14, the fluid goes from the gaseous state to a diphasic state, then from the diphasic state to the liquid state (two phase changes). Thus, the condenser 14 includes a segment 14*a*, along which the fluid is in the gaseous state, a segment 14*b* along which the fluid is in the diphasic state, and a segment 14*c*, along which the fluid is in the liquid state.

In the case where the fluid is in the diphasic state, a coefficient $\alpha$ is applied to calculate the densities. This coefficient $\alpha$ is better known as volume fraction, or void fraction. This is the ratio between the volume occupied by the gas and the volume occupied by the liquid. In a manner well known in the literature, it is calculated from thermodynamic properties according to semi-empirical correlations.

Typically, the volumes of the segments 14*b* and 16*a* are weighted with this coefficient $\alpha$.

During a later step e), the values calculated in steps c) and d) are next used to calculate the total mass M of refrigerant contained within the air conditioning system, using the following formula:

$$M=\overline{\rho}_{evap}*V_{internal,evap}+\overline{\rho}_{cond}*V_{internal,cond}+\overline{\rho}_{receiver}*V_{internal,receiver}+\Sigma_i\overline{\rho}_{tube,i}*V_{internal,tube,i}$$

One next compares, during a step f), the total mass M of refrigerant calculated in step e) with the total mass of refrigerant originally contained within the air conditioning system.

More specifically, step f) advantageously consists of determining a health index $HI_{charge}$ of the air conditioning system 8, by obtaining the quotient of the total mass M of refrigerant calculated in step e) over the total mass of refrigerant originally contained in the air conditioning system. Typically, the total mass M of refrigerant is calculated in step e) by the calculator 40, which also copulate the health index $HI_{charge}$ of the air conditioning system 8. To that end, the mass of refrigerant originally contained in the air conditioning system 8, i.e., in new condition, is stored as an input parameter in the information recording medium 44 of the calculator, i.e., in the memory.

Typically, the health index $HI_{charge}$ is compared with a reference value, for example of about 80%, the air conditioning system then being considered no longer to work in a satisfactory manner if the health index is below the reference value, and otherwise being considered to work in a satisfactory manner.

Preferably, the process includes a step g) consisting of automatically emitting an alert signal if, at the end of step f), the air conditioning system is determined as no longer working in a satisfactory manner. This alert signal may for example take the form of an illuminated indicator lighting up on the driver's dashboard.

Advantageously, steps a) to f) are reiterated over time during the operation of the air conditioning system 8, preferably regularly with a predefined frequency. Typically, steps b) to f) are carried out automatically by the electronic calculator 40.

Alternatively, the air conditioning system 8 according to the invention is also applicable to railway vehicles not intended to carry passengers, for example locomotives, maneuvering vehicles such as light rail motor tractors, or railway maintenance vehicles. The air conditioning system 8 is then advantageously used to supply air conditioning to a space 10 received inside this vehicle, for example associated with a driver cabin or a merchandise transportation space.

The features of the embodiment and various considered alternatives that are not shown may be combined with one another to create new embodiments.

The invention claimed is:

1. A process for monitoring an air conditioning system of a railway vehicle, said air conditioning system including several components, which include a compressor, a condenser, an evaporator, an expander and a refrigerant circuit, said air conditioning system being intended to provide air conditioning for a zone located inside the railway vehicle, said process comprising steps consisting of:

a) after starting the air conditioning system, measuring physical properties relative to refrigerant in the air conditioning system;

b) from the physical properties measured during step a), calculating thermodynamic properties;

c) from the thermodynamic properties calculated during step b), calculating a density value of the refrigerant inside each component of the air conditioning system;

d) using manufacturer data, which includes dimensions of each component of the air conditioning system, calculating a passage volume value of the refrigerant inside each component of the air conditioning system;

e) using the values calculated in steps c) and d) to calculate a total mass of refrigerant contained inside the air conditioning system;

f) comparing the total mass of refrigerant calculated in step e) with a total mass of refrigerant originally contained inside the air conditioning system, wherein step f) consists of determining a health index of the air conditioning system by obtaining the quotient of the total mass of refrigerant calculated in step e) over the total mass of refrigerant originally contained in the air conditioning system; and g) generating a user output if, at the end of step f), the health index is below a reference value.

2. The process according to claim 1, wherein, during step a), the measuring of the physical properties includes measuring:

a pressure of the refrigerant at an inlet of the compressor;

a pressure of the refrigerant at an outlet of the compressor;

a temperature of the refrigerant at an inlet of the condenser;

a temperature of the refrigerant at an outlet of the condenser;

a temperature of the refrigerant at an inlet of the evaporator;

a temperature of the refrigerant at an outlet of the evaporator;

a temperature of the refrigerant at an inlet of the compressor; and a temperature of the refrigerant at an outlet of the compressor.

3. The process according to claim 2, wherein, during step a), the temperature of the refrigerant at the inlet of the compressor and the temperature of the refrigerant at the outlet of the evaporator are measured by a same temperature sensor and/or the temperature of the refrigerant at the inlet of the condenser and the temperature of the refrigerant at the outlet of the compressor are measured by a same temperature sensor.

4. The process according to claim 1, wherein steps a) to f) are reiterated over time during the operation of the air conditioning system.

5. The process according to claim 4, wherein steps a) to f) are reiterated regularly with a predefined frequency.

6. The process according to claim 1, wherein step a) is carried out automatically using sensors and steps b) to f) are carried out automatically by an electronic calculator.

7. The process according to claim 1, wherein the determined health index is compared with the reference value, the air conditioning system being considered to no longer work in a satisfactory manner if the health index is below the reference value, and otherwise being considered to work in a satisfactory manner.

8. The process according to claim 7, wherein the generated user output in step g) is an emitted alert signal indicating the air conditioning system is no longer working in the satisfactory manner.

9. The process according to claim 1, wherein the thermodynamic properties calculated in step b) include:

an enthalpy at the inlet of the evaporator;

an enthalpy at the outlet of the evaporator;

a mass flow rate of the compressor;

an enthalpy at the inlet of the condenser;

an enthalpy at the outlet of the condenser;

an enthalpy absorbed by the compressor; and an enthalpy supplied by the compressor.

10. The process according to claim 1, wherein step c) consists of calculating an averaged density of the refrigerant inside each component of the air conditioning system.

11. A railway vehicle comprising an air conditioning system for supplying air conditioning to a zone located inside the railway vehicle, said air conditioning system including several components, which include a compressor, a condenser, an evaporator, an expander and a refrigerant circuit, the air conditioning system further including sensors for measuring physical properties relative to refrigerant in the air conditioning system after the air conditioning system is turned on, the railway vehicle further comprising an electronic calculator intended to control the air conditioning system and programmed to carry out steps consisting of:

calculating thermodynamic properties from the measured physical properties;

calculating a density of the refrigerant inside each component of the air conditioning system from the thermodynamic properties using manufacturer data, which includes dimensions of each component of the air conditioning system, calculating a passage volume of the refrigerant inside each component of the air conditioning system;

from the calculated density and passage volume of the refrigerant inside each component, calculating a total mass of refrigerant contained inside the air conditioning system; and comparing the calculated total mass with a total mass of refrigerant originally contained inside the air conditioning system, wherein the comparing consists of determining a health index of the air conditioning system by obtaining a quotient of the total mass of refrigerant calculated in the calculating of the total mass of refrigerant contained inside the air conditioning system over the total mass of refrigerant originally contained in the air conditioning system.

* * * * *